United States Patent [19]

McMullan et al.

[11] 4,139,763

[45] Feb. 13, 1979

[54] BLANKET HEATER WITH TEMPERATURE CONTROL MEANS

[76] Inventors: James P. McMullan; Albert Stevens, both of 2630 Seaman Ave., El Monte, Calif. 91733

[21] Appl. No.: 885,304

[22] Filed: Mar. 10, 1978

[51] Int. Cl.[2] ..... H05B 3/34

[52] U.S. Cl. ..... 219/528; 219/212; 219/512; 219/530; 219/544

[58] Field of Search ..... 219/211, 212, 494, 516, 219/527, 528, 529, 530, 535, 540, 544, 549; 338/212; 126/256, 399

[56] References Cited

U.S. PATENT DOCUMENTS

| | | | |
|---|---|---|---|
| 2,018,512 | 10/1935 | DeLaney et al. | 219/528 |
| 2,114,396 | 4/1938 | McFarlan et al. | 219/528 |
| 2,349,612 | 5/1944 | Campbell | 219/528 |
| 2,617,011 | 11/1952 | MacKendrick | 219/528 |
| 2,745,942 | 5/1956 | Cohen | 219/528 |
| 3,336,557 | 8/1967 | Lund et al. | 219/528 |
| 3,440,407 | 4/1969 | Goltsos et al. | 219/494 |
| 3,657,517 | 4/1972 | Hoyt | 219/535 |
| 3,790,753 | 2/1974 | Miller | 219/549 X |
| 3,889,101 | 6/1975 | Woods | 219/527 |
| 3,904,850 | 9/1975 | Johnson | 219/528 |

*Primary Examiner*—Volodymyr Y. Mayewsky
*Attorney, Agent, or Firm*—Georges A. Maxwell

[57] ABSTRACT

An electric resistance heater engageable with work to be heated including a work-engaging heater structure of minor thermal mass per unit area and including an elongate primary heating element arranged to establish high watt density throughout said heater structure, a power supply, a temperature control means between and connected with the primary heating element and the power supply; said temperature control means including a work engaging body of greater thermal mass per unit area than the heater structure and carried by said heater structure in spaced relationship with the primary heating element, a normally closed thermal responsive switching device within the body and operable to open when the temperature of the body is heated by heat conducted from the work to a predetermined operating temperature, an elongate secondary heating element arranged in the body to delivery sufficient heat into the body to normally maintain the temperature thereof at a temperature slightly below said operating temperature whereby little heat need be conducted from the work into the body to raise its temperature to said operating temperature, said elements and device being series connected with the power supply. The device further includes a heat pipe extending between the heater structure adjacent the primary heating element and the body to rapidly and directly conduct heat and to raise the temperature of the body to said operating temperature when the temperature differential between the heater structure and body becomes excessive and before the temperature of the heater exceeds a predetermined maximum operating temperature.

9 Claims, 10 Drawing Figures

BLANKET HEATER WITH TEMPERATURE CONTROL MEANS

This invention has to do with an electric resistance heater and is particularly concerned with a novel, thin, light-weight blanket-type heater structure with novel integrated temperature control means.

Flat, flexible, blanket-type resistance heaters with integrated temperature control means are commonly used throughout the arts. As a general rule, such heater structures are designed and constructed for use in specific environments requiring the provision of heater means to supply heat over wide areas of structures to be heated and where limited space for a heater structure is provided.

One typical use for blanket heaters of the character referred to above is to heat water beds. In the heating of water beds, flat, flexible, blanket-type heater structures are commonly arranged beneath the bottom or lower sides of the water filled bladder like mattresses of such beds and the top surfaces of supporting floor structures or the like.

In the following, for the purpose of this disclosure, we will describe a heater structure embodying our invention which is particularly suited for use in heating water beds and when appropriate will describe the heater as being put to such use. It is to be understood, however, that our new heater structure is suitable for use in many other general and/or specific environments.

The basic or common blanket-type resistance heater comprises a flat, flexible, rectangular envelope of rubberized or plasticized fabric or the like and an elongate resistance element in the form of a jacketed resistance wire, arranged within the envelope in a zig-zag or serpentine manner to extend throughout the major plane of the envelope. Junction means are provided within the envelopes to connect the resistance wires with suitable power cords which extend from the heater structures to suitable power supplies remote from the heater structures. When integrated temperature control means are provided, such means commonly include a normally closed temperature responsive switching device, such as a thermostatic switch, engaged in the envelope and series connected in or with the resistance wire. The switching devices are operable to open when the temperature of the envelopes adjacent thereto reach a set, predetermined, elevated temperature.

In establishing blanket-type heaters with integrated temperature control means of the general character referred to above, it has been found necessary, in most instances, to make the thermal mass per unit area of such heaters substantially uniform throughout their entire extent so that uniform rate of heating and cooling of the structures and efficient temperature control thereof can be attained. Accordingly, the thermal mass per unit area of such heaters remote from the area of the junction means and the temperature control means must be approximately the same as the thermal mass per unit area at and about said junction and temperature control means. Such similarity and/or balancing of masses is required since areas of different masses have different heat storing capacity and each requires the input and output of a different number of BTU's to change its temperature to the same extent that the temperature of areas of dissimilar masses are changed.

In accordance with the above, if the mass per unit area of the heater structure at and adjacent the junction and temperature control means in a blanket heater is materially greater than the mass per unit area of the remainder or heating area of the heater structure, the said heating area or remainder of the heater structure, which is of minor mass per unit area, will heat or cool at a faster rate than the area of greater mass at and about the junction and control means. As a result of the foregoing, the control means will be rendered incapable of responding to changes in temperature of the heating area of the structure in a serviceable and proper manner. Heating of the area of greater mass to operating or set temperature of the switching device will be delayed and the area of minor mass will continue to generate heat after the desired temperature is exceeded and until the area of greater mass reaches said temperature. Prolonged, extended heating of the heating area of such heaters necessarily results in overheating and can result in the burning out of the construction or of the structure with which the heater is related.

In heater structures having dissimilar masses as noted above, cooling of the areas of minor mass is also more rapid than cooling of the areas of greater mass, with the result that the heating areas over-cool before the areas of greater mass drop to that temperature where the temperature control means operates to again energize the heater structures.

The above noted slow and undesirable, if not detrimental, response of the temperature control meas in blanket-type heaters having dissimilar masses results in extreme fluctuations in temperature where a constant temperature is desired.

In efforts to compensate for the above noted shortcomings, when they occur in heater structures, the watt output of the heaters is sometimes increased to effect faster heating and therefore reduce the time response of the control means.

As a result of the foregoing, the thermal mass per unit area of the heating areas of heaters of the character referred to above with integrated temperature control means is, in accordance with good practice, controlled by and made substantially equal with the thermal mass per unit area of the constructions at and about the junction and temperature control means thereof. That is, the necessary thermal mass per unit area of the areas at and about the junction and control means determines the minimum thermal mass per unit area of the remainder or heating area of the heater structures. In turn, the resulting mass per unit area of such heaters dictates, in large part, the required watt output of such heaters. That is, the greater the mass per unit area of such structures, the greater is the required watt output thereof.

The foregoing has resulted in a situation where most blanket-type heaters are generally heavier and greater in mass per unit area and have greater watt output than their intended use would dictate for most effective and efficient operation.

There exists a want and a need for a blanket-type resistance heater structure with integrated temperature control means which is such that the heating area of the structure, remote from the junction and temperature control means can be materially thinner and lighter in mass per unit area than the required mass per unit area of the construction at and about said junction and temperature control means, whereby the major portion of the heater requires less space; heating can be effected with less watt output; and the time response to temperature changes is faster.

In the art of flexible blanket-type heaters of the general character referred to above, it has been suggested that having an extensive, yet very thin and light, flexible heater structure might be effectively produced by employing the art of printed circuitry, that is, that the heater circuits be established on thin layers of flexible sheet material by a suitable printing and etching process. To the best of our knowledge and belief, efforts to establish flexible blanket-type heaters employing the art of printed circuitry, as noted above, have failed to bring about acceptable results. Others in the art have determined that the establishing of flexible heaters using such techniques is not economically and/or functionally practical in other than relatively small sizes.

An object and feature of our invention is to provide a novel flexible blanket-type heater structure with a novel integrated temperature control means of the general character referred to above wherein the thermal mass per unit area of the basic blanket structure remote from the control means is materially less than the thermal mass per unit area of that portion of the heater structure at and about the control means.

It is another object of our invention to provide a heater construction of the character referred to which is such that the integrated control means of major mass heats and cools at substantially the same rate as the remainder of the construction which is of minor mass, whereby the time lapse between temperature changes in the areas of different masses is sufficiently short so that excessive heating and cooling of the construction does not occur and so that the construction operates to maintain a substantially uniform temperature.

Yet another object and feature of our invention is to provide a structure of the general character referred to above wherein the integrated control means includes independent resistance heating means which operates to normally maintain the temperature of the are of greater mass at a temperature slightly below the predetermined set operating temperature of the construction.

Another object and feature of our invention is to provide a heater structure of the character referred to above wherein the integrated control means includes heat conductor elements or heat pipes extending between the area of different masses to conduct heat from the areas of minor masses to the area of greater mass to supplement the independent resistance heating means of the control means when the temperature of the area of minor mass rises rapidly and excessively and the temperature differential between the areas of different mass is excessive; and, to conduct heat from the area of greater mass to the area of lesser mass and to lower the temperature of the area of greater mass when the temperature of the area of greater mass exceeds the temperature of the area of minor mass.

Yet another object and feature of our invention is to provide a heater construction of the character referred to above wherein the integrated control means includes independent resistance heater means to normally temper or heat the area of greater mass and which supplements the function of the heat pipes when heat is conducted into the area of greater mass thereby.

It is another object and feature of our invention to provide a heater structure of the general character referred to above wherein the heat conductors are elongate flexible straps or ribbons of metal having a high index of heat conductivity arranged in direct heat conducting contact with and extend between the areas of different mass and electrically insulated from the electrical components or parts of construction.

Still another object and feature of our invention is to provide a heater structure of the general character referred to above which includes a flat sheet-like core of flexible, electrically non-conductive, dimensionally and thermally stable plastic material; a resistance heater element of thin, flexible electric conductive metal foil bonded to a flat surface of the core and an envelope of flexible, electrically nonconductive heat conducting and thermally stable plastic sheeting or film engaged about and bonded to the core to hermetically seal and electrically insulate the core and the heater element.

An object and feature of the present invention is to provide a heater structure of the character referred to above wherein the heating element is established by bonding a layer of metal foil on a surface of the core; printing the electrical current to be established on the surface of the foil with an etching compound resistance ink; bathing the laminated core and foil in an etching compound to remove the unprinted portions of the foil and finally, bathing the core and the remaining foil circuit thereon to remove residual etching compound and ink therefrom.

It is an object and feature of our invention to provide a structure of the character referred to above wherein the planar dimensions of the heater structure is limited only by the dimensional limitations of the sheet stock from which the laminates thereof are established and the facilities and equipment employed in its manufacture.

Yet another object of our invention is to provide a structure of the character referred to above wherein the core, foil element and envelope about the core and element can be advantageously established of sheet stock which is as little as two mills thick, whereby a durable and serviceable, flexible blanket heater which is as little as eight or nine mills thick throughout its major extent can be easily and economically mass produced.

Still another object and feature of our invention is to provide a heater structure of the character referred to in the foregoing wherein the foil heating element is an elongate foil ribbon-like element suitably laid about its related surface of the core with terminal end portions occurring in side by side relationship adjacent one end of the core and whereby the temperature control means is arranged adjacent said one end portion of the core and is related with said terminal end portions of the element.

Another object and feature of our invention is to provide a structure of the character referred to wherein the independent heater means of the control means includes resistance heater elements established in said end portions of the heater element at said one end of the core.

It is another object and feature of our invention to provide control means of the general character referred to including a first normally closed thermo responsive switching device in heat conducting contact with the heater structure adjacent said one end portion of the core and operable to open when the temperature of that portion of the structure reaches or exceeds one predetermined operating temperature; and a second normally closed thermo responsive switching device in heat conducting contact with the heater structure adjacent said one end portion of the structure and operable to open when the temperature of the structure reaches or exceeds a second predetermined temperature.

It is an object of our invention to provide a structure of the general character referred to above wherein said end portions of the heater element are provided with terminal tabs at their free ends, which terminal tabs are connected with lines of a power supply cord and wherein said switching devices are interposed in and series connected with said end portions of the element.

It is an object of our invention to provide a structure of the general character referred to above wherein said switching devices, terminal tabs and related power supply lines are imbedded within and carried by a body of insulating and protective material forming a part of the heater structure.

The foregoing and other objects and features of our invention will be fully understood from the following detailed description of one typical preferred form and application of our invention throughout which description reference is made to the accompanying drawings in which.

For the purpose of clear disclosure, the heater construction that we provide can and will be divided into two separable sections or structures, there being a primary heater section or structure H and a control section or means M.

Figure 1:
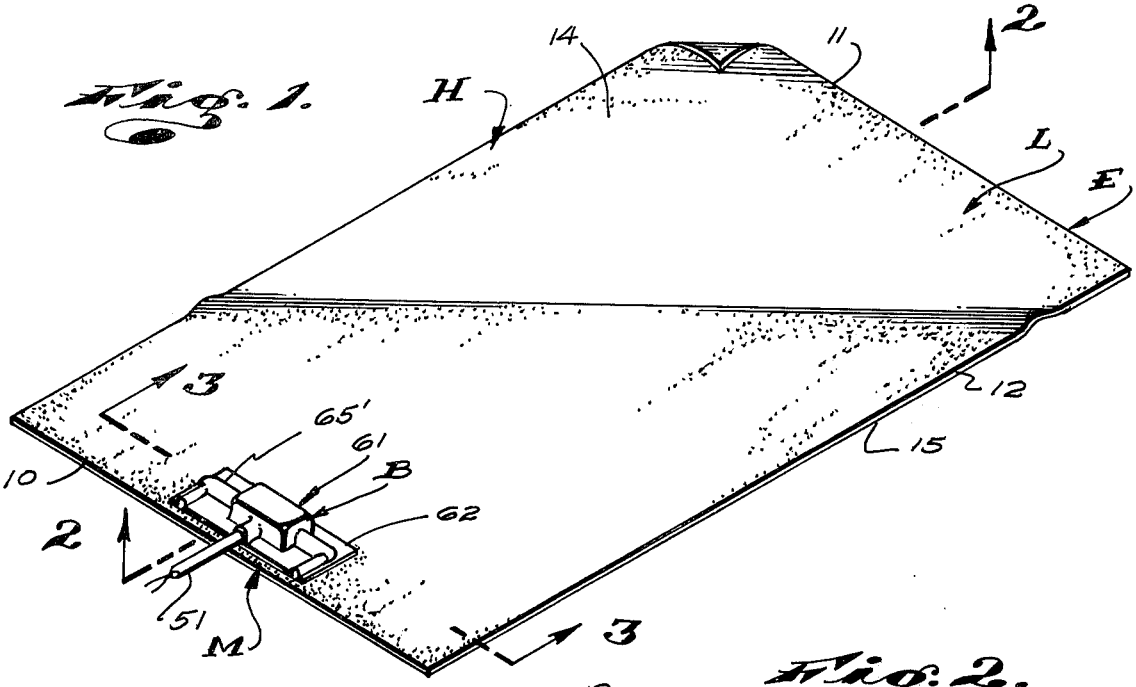
FIG. 1 is an isometric view of a heater embodying the invention.
Figure 2:
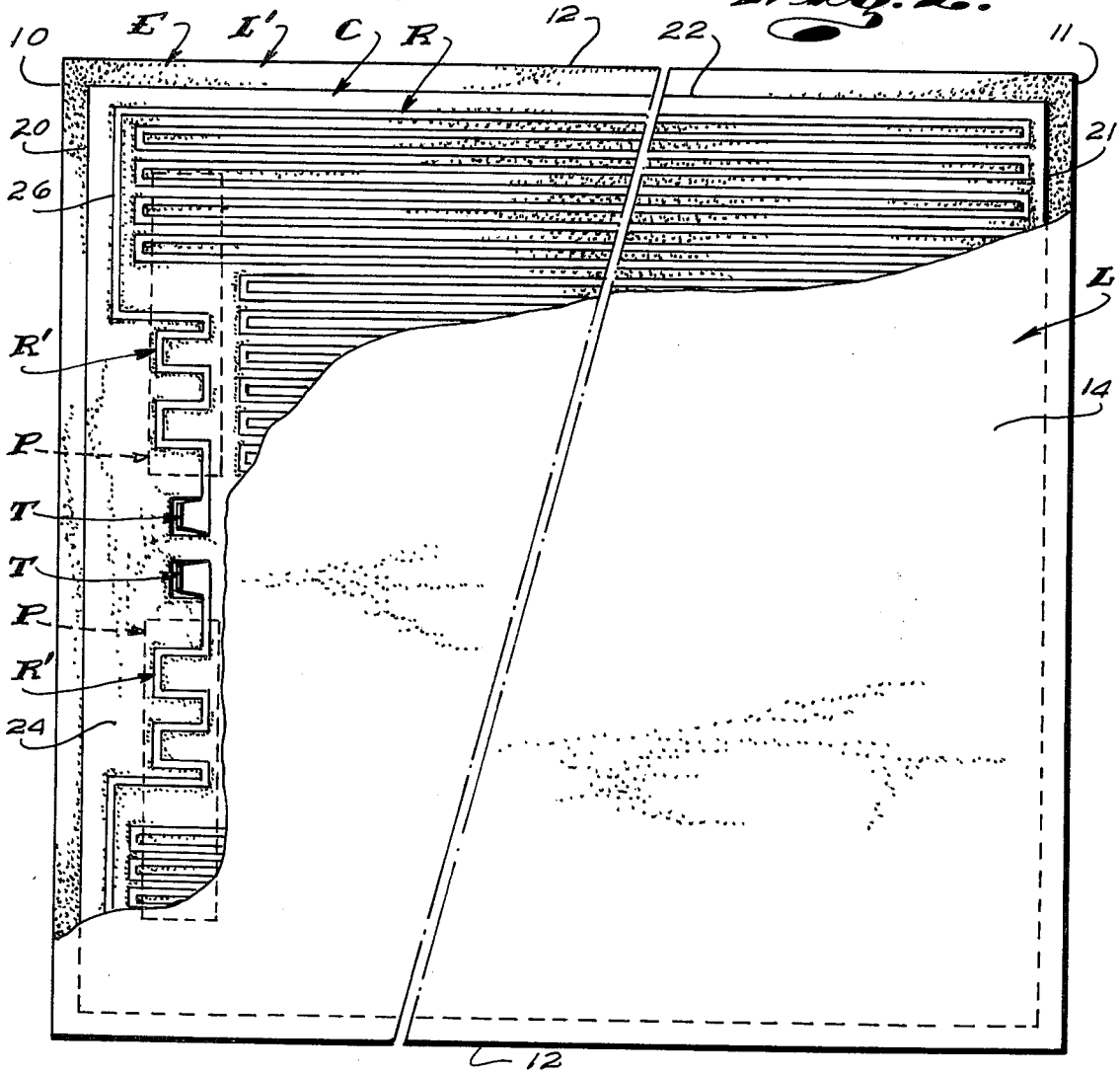
FIG. 2 is a view taken substantially as indicated by line 2—2 on FIG. 1.
Figure 3:
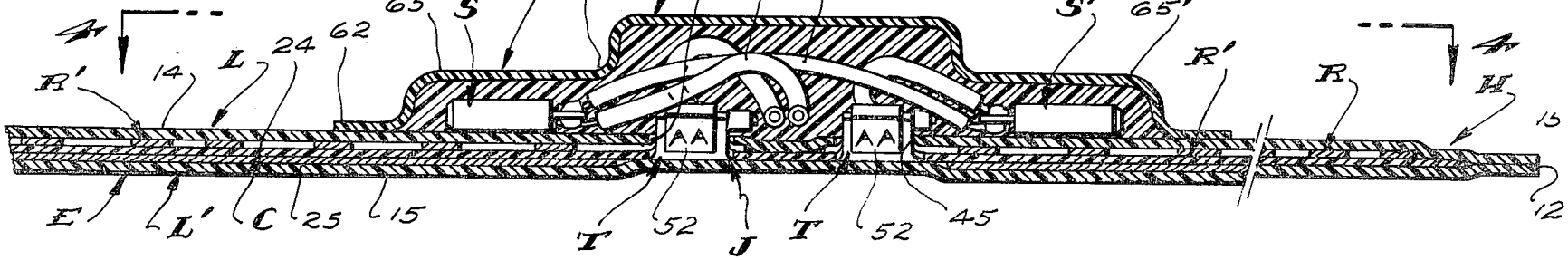
FIG. 3 is an enlarged detailed sectional view taken substantially as indicated by line 3—3 on FIG. 1.
Figure 4:
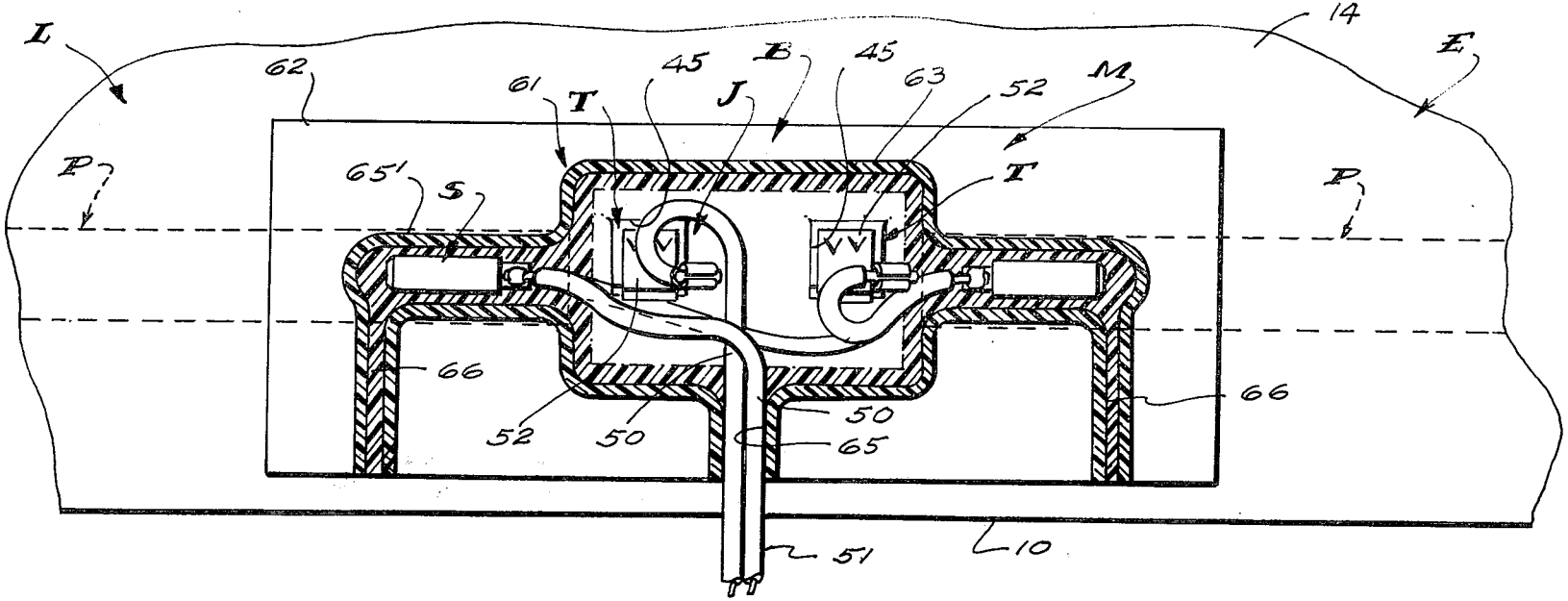
FIG. 4 is a sectional view taken substantially by line 4—4 on FIG. 3.

The heater structure H is an elongate flat rectangular unit with front and rear edges 10 and 11, side edges 12 and flat top and bottom surfaces 14 and 15. The control means M is located at the front end portion of the heater structure H and includes, in addition to other parts and means, a junction means J and an enlargement or body B which projects upwardly from the top surface 14 of the structure H, substantially as shown in FIG. 1 of the drawings and which contains the means J is encapsulated.

The heater structure H is a laminated structure and includes a middle strait or core C, an electric resistance heater element R carried by the core and an envelope E about the core C and element R and composed or made up of top and bottom straits or layers L and L'.

The middle strait or core C is a flat, thin, flexible sheet of suitable mechanically or dimensionally and thermally stable plastic material. In practice, the core C is preferably established of that polymeric plastic film manufactured by Du Pont and sold under the tradename Mylar. Mylar is electrically non-conductive and dimensionally stable under those mechanical and thermal stresses which are likely to be encountered in the anticipated use to which the heater structure H will be put.

Further, Mylar is sufficiently strong and dimensionally stable so that it can be advantageously provided in the form of extremely thin very flexible sheeting or film without adversely diminishing its strength and its stability for use in carrying out our invention.

While it has been determined that Mylar film stock as little as two or three mills thick can be advantageously and effectively used in establishing the core C of our heater structure H, it has been determined that Mylar stock which is about five mills thick is generally sufficiently thin to impart desired flexibility to the core C and affords a desired safety factor with respect to strength and resistance to dimensional distortion.

The core C has front, rear and side edges 20, 21 and 22 and has flat, substantially smooth, top and bottom surfaces 24 and 25. The core C is slightly less in longitudinal and lateral extent than the envelope E structure in which it is arranged, so that its above noted edges 20, 21 and 22 occur inward of the edges 10, 11 and 12 of the structure H when that structure is completed or finished.

The resistance heater element R is comprised of an elongate, flat ribbon of metal foil arranged on and about the top surface 24 of the core C. While the element R can be established of various metals and alloys, it is preferably established of alluminum foil which, for example, is about two mills thick. The foil ribbon like element can be varied in lateral extent to change or adjust its resistance or electrical capacity and the lateral spacing between adjacent portions of the element can be varied to change or adjust the watt density of the heater, as desired, and as circumstances require.

As shown in the drawings, the element R is arranged in a zig-zag or serpentine like manner from one side portion to the other and longitudinally of the core to extend throughout the major plane area or extent of the top surface 24 of the core. The element R has elongate end portions 26 extending laterally inwardly from opposite side portions of the core C adjacent the front end 20 thereof. The portions 26 terminate and are integrally joined with a pair of laterally spaced enlarged, square or rectangular foil terminals T arranged centrally on the top surface 24 of the core. The terminals T are parts of the junction means J. The end portions 26 of the element R, laterally outward of the terminals T are provided with zig-zag or serpentine like portions which establish a pair of independent secondary heating elements R' which are parts of the control means M to be hereinafter described.

The elements R' and element R are spaced a substantial distance from each other so that each functions to heat its related areas of the construction substantially independent of the other.

The elements R' need not be in series with the primary element R as shown. In practice, the elements R' can separate heating elements established on the top surface 24 of the core and suitably connected with the terminals T and in parallel relationship with the element R. In such a case, the above noted elements R' can be established of resistance wire, rather than foil, if desired or if circumstances require.

The structure thus far described, comprising the core C, metal foil heating elements R and R′ and the terminals T constitute a basic sub-assembly A for the heater structure H.

The sub-assembly A is such that it requires the use of special equipment and the exercise of special skill and care to assure successful and practical mass production thereof.

Figures 5, 6, 7, 8, 9, 10:
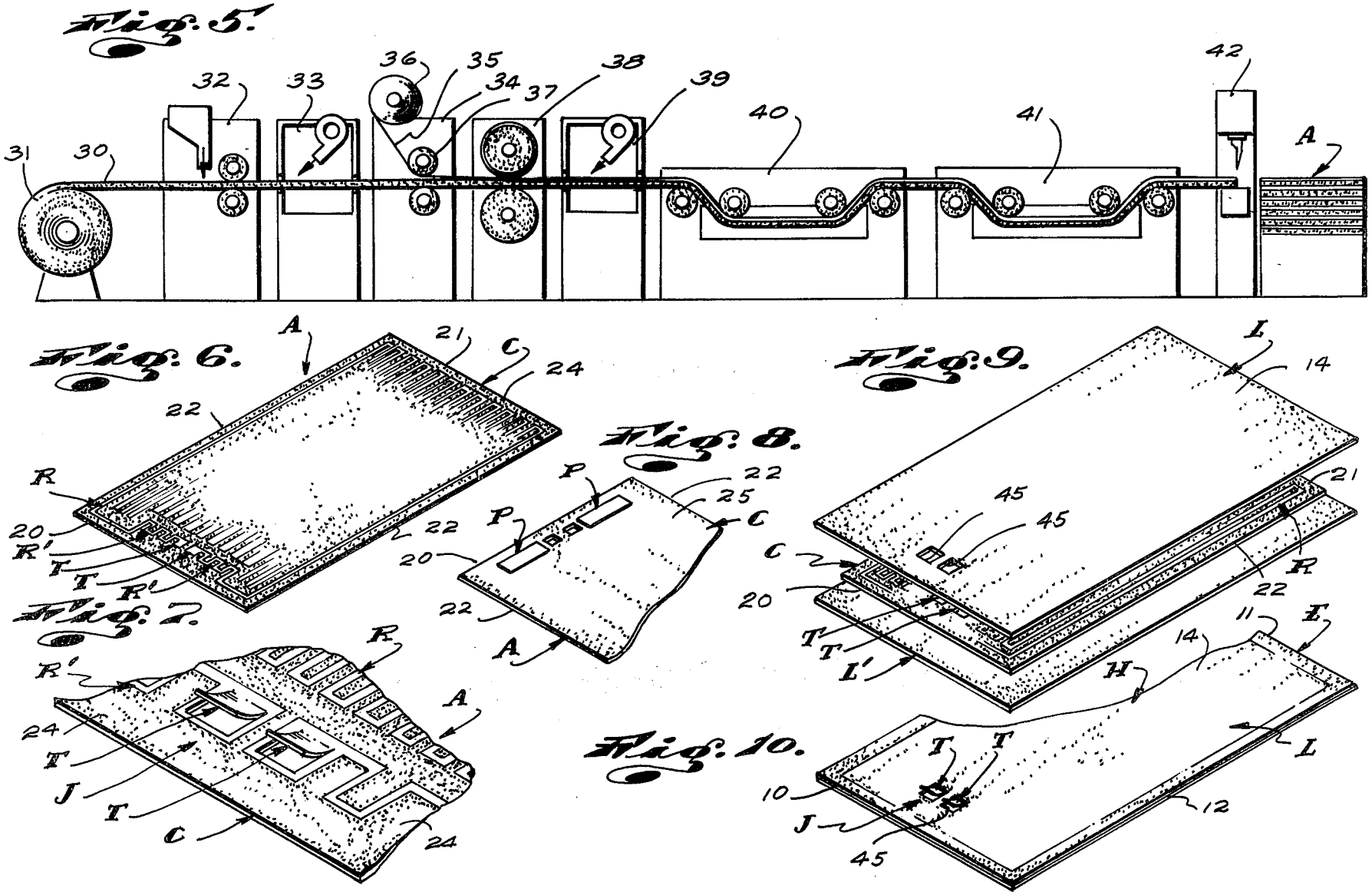
FIG. 5 is a diagrammatic view showing certain of the apparatus and method steps employed in establishing a sub-assembly of our heater structure.
FIG. 6 is an isometric view of a heater sub-assembly that we provide.
FIG. 7 is an enlarged view of a portion of the sub-assembly shown on FIG. 6 with work having been performed thereon.
FIG. 8 is an isometric view of a portion of the structure shown on FIGS. 6 and 7 with heat pipes applied thereon.
FIG. 9 is an isometric view showing envelope forming sheets positioned for engagement with the heater sub-assembly.
FIG. 10 is an isometric view of the enveloped heater structure that we provide with parts of the control means removed therefrom.

In FIG. 5 of the drawings, we have diagrammatically illustrated the means and method that we provide to produce the sub-assembly A.

The method steps in producing the sub-assembly A include; first, application of an adhesive on one surface of a sheet of Mylar film stock; second, partially drying and curing the adhesive so that it remains pressure-sensitive, but free of free liquids and/or gases; third, applying an alluminum foil sheet on said adhesive coated surface and applying pressure thereto to establish uniform bonding between the core and foil; fourth, printing the resistance elements and terminals to be established on the exposed surface of the foil with an etching compound resistant ink; fifth, drying the ink and finally, curing the adhesive; sixth, bathing the printed laminated core and foil in an etching solution and permitting the solution to remove the unprinted portion of the foil and to thereby establish the foil elements and terminals; and, finally, bathing the sub-assembly A in a solution to neutralize and/or remove residual etching compound and ink therefrom.

It has been determined that to attain an effective bond between the Mylar core stock and the alluminum foil, the surface of the Mylar stock must be suitably conditioned to assure proper adhesion of the bonding compound or adhesive therewith.

Further, it has been determined that the adhesive must be suitably dry and free of volatile liquids and the like at the time that the foil is applied to avoid the presence of liquids and/or vapors between the foil and the core which might prevent bonding of the two together or which mighr result in blistering and separation thereof. Further, the adhesive must be such that when it is cured, it becomes substantially dimensionally stable and will not permit or allow for relative movement between the core and the foil. In this regard, a suitable solvent based, two part cross-linking adhesive is employed. A suitable and desirable solvent is methylethylcetone which has a latent temperature of vaporization of about 70° F. Methethylcetone is such that when mixed with the adhesive and when the adhesive is thinly and uniformly applied to the surface of the Mylar core stock, it will attack or dissolve the surface of the Mylar stock. In furtherance of our invention, the noted solvent is used in such volume and for such controlled and limited periods of time that it only works upon the surface of the Mylar core to soften and/or condition that surface so that adhering of the adhesive on that surface is assured.

The solvent based adhesive is applied uniformly to the surface of the core stock and the solvent is evaporated and/or driven therefrom by a suitable dryer means so that the period of time the solvent can act upon the Mylar is controlled.

It is to be noted that the cross-linking adhesive here employed does not commence to set up and cure until the solvent is driven off and is such that it requires some period of time to cure to a non-tacky state. The adhesive is such that its curing time can be materially shortened by the application of heat.

Referring to FIG. 5 of the drawings, the Mylar film stock 30 is carried by a supply roller 31. The stock 30 is fed and advanced through an adhesive applicator means 32 which applies the solvent based adhesive to the top surface thereof in a thin and uniform manner. The stock 30 with the adhesive applied thereto is next advanced through a hot air dryer means 33 to drive the solvent therefrom. Thereafter, the stock 30 advanced through a laminating means 34 which receives alluminum foil 35 from a supply roll 36 and applies that foil to the still uncured adhesive covered surface of the core stock 30. The means 34 includes pressure roller means 37 which serve to assure tight, uniform contact between the foil and the adhesive on the core stock 30 and which effectively squeezes out any vapors, liquids and/or gases that might otherwise remain between the core stock and the foil.

The laminated core stock and alluminum foil is next advanced through a printing means 38 which prints the circuit or heating elements and contacts to be established on the top surface of the foil with a suitable masking or etching compound resistant ink. The printing means can, for example, include a lower platen roller and a top roller carrying a printing plate such as is diagrammatically illustrated in the drawings. It will be apparent that if desired, the printing means could be replaced by a suitable silk-screening apparatus or the like without departing from the spirit of our invention.

The printed laminated foil and core stock is next advanced through a hot air dryer means 39 which dries the ink and which heats the structure to finish curing the adhesive.

The cured, printed, laminated foil and core stock is next advanced through a bath 40 of etching compound which removes the unwanted or unprinted portion of the foil from the core and leaves the alluminum foil heating elements and terminals thereon.

The core stock 30, with the heating elements and terminals thereon is next advanced through a bath 41 which neutralizes and/or removes the residual etching compound and which removes the ink from the exposed surfaces of the heating elements and terminals.

Finally, the core stock 30, with the foil heating elements and terminals thereon is advanced through a shear 42, which shears or cuts the stock, intermediate each portion thereof on which related heating elements and terminals are established and thereby establishes core sub-assemblies A, ready for subsequent use in establishing heater construction in accordance with our invention.

In furtherance of our invention, the subassembly A for each heater structure H is pierced at each of the terminals T of the junction means J to establish terminal tabs which are flexed and/or bent upwardly for free and convenient access, as clearly illustrated in FIG. 7 of the drawings.

Next, a pair of elongate flat heat conductors or heat pipes P which are elements or parts of the control means M are cemented or otherwise fixed to the bottom surface 25 of the core C in heat conducting contact therewith. The heat pipes P have inner end portions which occur adjacent and underlie the portions of the core on which the heating elements R′ are carried, have outer portions which occur adjacent to and extend beneath the portions of the core on which the primary heater element R is carried and having intermediate portions which extend across or bridge the space between the elements R and R'.

The heat pipes P are preferably established of thin, flexible ribbon-like strips of metal having a high index of heat conductivity. For example, the heat pipes can be established from copper or brass shim stock of from two to five mills thick.

It is to be noted that the heat pipes at the bottom surface of the core C are electrically insulated from the heater elements R and R', at the top surface 24 of the core.

After the sub-assembly A, with its terminal tabs T formed thereon and the heat pipes P applied thereto, as noted in the foregoing, the envelope structure E is related to it to electrically and hermetically insulate and seal that sub-assembly.

The envelope E, as shown in FIG. 9 of the drawings, includes the above noted top and bottom laminates L and L'. The laminates L and L' are preferably flexible sheets of plastic material arranged adjacent to and overlying the top and bottom surfaces 24 and 25 of the core and having edge portions which project outwardly from about the perimeter of the core and which are bonded or welded together. The top laminate L is formed with a pair of windows or apertures 45, through which the upwardly turned terminal tabs T freely project when the laminate L is arranged over and is engaged with the top of the core, as clearly illustrated in FIGS. 3, 4, 9 and 10 of the drawings.

The laminate L defines the top surface 14 and the laminate L' defines the bottom surface 15 of the finished heater structure H while the edges of the laminates L and L' cooperate to define the front, rear and side edges 10, 11 and 12 of the heater structure H.

In practice, the laminates L and L' of the envelope E for the heater structure H can be advantageously established of polyvinylchloride film. It is to be noted that while the envelope must be established of material having appropriate thermal stability in the range of temperatures to be encountered, dimensional stability of the envelope is of minor importance since each stability is imparted into the construction by the core.

In practice, the laminates L and L' need not be thicker than the core. However, it is considered desirable that they be at least five mills thick and possibly thicker if durability and safety of the construction so dictates.

The laminates L and L' of the envelope E are bonded to their related surfaces 24 and 25 of the core C by a suitable adhesive which can be manually applied to the noted surfaces of the core and/or to the laminates immediately prior to placement of the laminates into engagement with the core assembly.

After the laminates L and L' are engaged with the core assembly and before the edge portions thereof are welded or heat sealed together, it is desirable that the assembly be pressed between suitable rollers or platens to displace and squeeze out any excess adhesives and gases that may otherwise remain within the laminate assembly and which might gas and cause blistering and/or separation of the laminate structure when in use.

Upon completion of the basic heater structure H set forth above, the elements and parts of the control means M that we provide, and which are not incorporated within the structure H are related to it. The control means M, in addition to the aforementioned secondary heating elements R' and heat pipes P, which are incorporated in the basic structure H, includes a pair of thermo responsive switching devices S and S'. The devices S and S' can be simple thermostatic switch units and are positioned on the top surface 14 of the top laminate L of the envelope E, immediately above the secondary heating elements R'. The laminate L effectively electrically insulates the switching devices from the elements R'. Each switching device S and S' is connected, in series, in one or the other of two like conductors or lines 50 of a power service cord 51 which extends from the heater structure to a remote electric power source (not shown). The ends of the lines 50 are connected with related terminals T by means of suitable sheet metal clamp type coupling parts 52. The terminals T, lines 50 and the coupling parts 52 combine to establish the above noted junction means J.

It will be apparent that the upper portions of the terminals T, the coupling parts 52, the lines 50 and the switching devices S and S' occur above and at the exterior of the heater structure H at the central forward portion thereof and are in close proximity to each other.

The above noted elements and/or parts occurring above the central forward portion of the heater structure H are fixed in place and are thermally, electrically and hermetically sealed and protected by a body or mass of potting material or compound 60 which is applied to the top surface 14 of the structure H and which defines the aforementioned upwardly protruding body B.

In practice, the potting material 60 which is provided to retain and protect the elements and parts of the construction related to it is preferably contained within a thin, pre-formed plastic shell 61 with a lower, flat, outer mounting flange portion 62 and an upwardly projecting central portion 63 defining a downwardly opening cavity to accommodate the devices S and S', terminals T, the end portion of the cord 51 and its lines 50 which are related to the means M and connected with the terminals T. The flange portion 62 of the shell 61 is cemented or welded to the top surface 14 of the envelope E, with the switching devices S and S', terminals T, lines 50 and portion of the cord 51 within the cavity defined by the central portion 63 of the shell. The shell 60 is provided with a central tunnel-forming trough 65 to accommodate the cord 51, which cord extends freely from the shell and is provided with a pair of lateral tunnel forming troughs 66 to facilitate introduction of potting material into the cavity and venting of the cavity, as potting material is introduced therein.

In the case illustrated, the central portion 65 of the shell establishes a large central cavity to accommodate the terminals T and has laterally extending wings 65' of reduced size, extending above the laterally spaced elements R' and accommodating the switching devices S and S'. The wings 65' are formed so that a predetermined, uniform thermal mass of potting material occurs about the switching devices S and S' and so that a predetermined exposed surface area is presented outward of and about said switching devices.

The switching device S is normally closed and is constructed or set to open when the temperature of the construction adjacent that device rises to a predetermined operating temperature. The other device S' is similar to the device S and is such that it opens at the same or some predetermined higher temperature than the device S. The device S' serves as a back-up for the device S should the device S fail to operate when and as intended.

Such dual control means is provided to satisfy and to meet certain existing safety codes which are applicable to heater structures of the general class here concerned with.

In practice, if a second or back-up thermo responsive switching device or means is not required, our heater construction can be made with but one secondary heating element R', a single heat pipe P, and a single thermo responsive switching device S, without departing from the spirit of our invention.

It is to be noted that the dimensional extent and mass of the body B are about as small as the components and parts which the body carries will permit and still provide those components and parts with that degree of thermal insulation, support and protection which is required.

It is to be particularly noted that the thickness and resulting thermal mass per unit area of the body B at and about the switches S and S' is many times thicker and greater in thermal mass per unit area than the heater structure H and that the heater structure H has less heat storing capacity and will heat faster than the body B upon the introduction of like BTU's into both the body and the structure H. The converse is true, that is, the structure H being of less mass and capable of storing less heat, will give up its stored heat and will cool faster than the body B.

In light of the above, and in the event the heating elements R' and the heat pipes P were not included in the construction illustrated and described above, the heater structure H would reach and pass the desired set operating temperature of the means M before the portions of the body B in which the switching devices are arranged reaches the temperature. During that period after the structure H has reached set temperature and until the body reaches that temperature, the temperature of the heater structure H will continue to rise and become overheated. After the temperature of the body B or area of greater mass in the construction has reached the set operating temperature and the switching device S opens, the heater structure H, of minor mass and remote from the body B or area of major mass, will give up its small amount of stored heat faster and will rapidly cool to that reduced temperature at which the device S closes a substantial period of time before the area of greater mass has cooled to that temperature where the device closes. During the period of time after the structure H cools to the temperature at which the device closes and until the body B or area of greater mass cools to that temperature, the structure H will cool excessively.

As a result of the foregoing, the heater construction without the elements R' and the heat pipes P would not operate to establish and maintain a close to uniform operating temperature. Rather, the construction would be turned on and off for protracted periods of time and the temperature would vary widely between excessively high and excessively low temperatures.

Most important, in the above example, due to the reduced and relatively small thermal mass per unit area of the special heater structure H, remote from the body B, the watt density is great and is such that if the heat generated by the element R is not conducted away at a sufficient rate by the structure being heated, rapid overheating and potential burning out of the heater structure is greatly increased. Such overheating and burning out of the heater structure must be guarded against.

In the invention that we provide, the resistance heaters R' of the temperature control means M, related to the temperature responsive switching devices S and S', and arranged within the body B or the area of greater mass, operate to heat the body or area of greater mass when the temperature of that mass is below the set operating temperatures of the device S and said device is closed, and ceases to heat that area of greater mass when the set temperature of the device S is reached and the device S opens. Heating of the area of greater mass by the elements R' is effected independent of the principal heater structure H which includes the element R. The watt output of the elements R' is less than the watt output of the element R per unit area and is such that it serves to supply and/or deliver heat to the area of greater mass in a quantity sufficient to normally maintain that area at a temperature slightly below the set operating temperature of the device S. Due to the greater heat storing capacity of the body B or area of greater mass, the temperatures of that area, during cyclical operation of the construction, changes or varies little.

While the elements R' are effective to temper and maintain the temperature of the area of greater mass at slightly below the set operating temperature of the temperature control switching device S, during cyclical operation of the construction, they heat their related area of the construction at a slower rate than the rate at which the element R heats the structure H and, working alone, would not heat their related area of the construction to set operating temperature for some substantial and excessive period of time after the heater structure H has reached and exceeded the set operating temperature of the construction.

The additional heat required to heat the area of greater thermal mass to the operating temperature of the device S is normally conducted into that area by the structure which is being heated by the heater and which is in heat conducting contact with the exterior surface of the body, about the wing portions 65 thereof. The small amount of additional heat required is quickly conducted into the body.

The heat pipes P of the means M and which extend between the two areas of dissimilar mass operate or function to supplement the elements R' by rapidly and directly conducting the heat from the heater structure H or area of minor mass to the body B or area of greater mass, when the temperature of the area of minor mass reaches a maximum safe operating temperature and when the temperature differential between the areas of major and minor mass become excessive. When these noted special conditions develop, the heat pipes rapidly and directly conduct from the area of minor mass to the area of major mass to cause opening of the device S before damage to the heater and/or related structure can take place.

With the heat pipes P, arranged and operating or functioning as noted above, it will be apparent that the temperature of the area of greater mass is raised and lowered rapidly above and below the set operating temperature of the device S, in response to corresponding changes in temperature of the heater structure H which would otherwise result in an excessive temperature differential between the area of dissimilar thermal mass. Since the body B or area of greater mass, the temperature of which must be changed to effect operation of the means M, is maintained at a temperature slightly below the set operating temperature by the heating elements R', the amount of heat which must be conducted from the heater structure H to the area of greater mass to effect sufficient heating of that mass to the operating temperature of the device S is small and such that it can be effected in an extremely short period of time by the heat pipes P or by conduction of heat from the structure being heated and contacting the body B, or both.

In accordance with the foregoing, the heating elements R' can be viewed separately and said to simply temper and normally maintain the body or area of greater mass in which the device S is arranged at a substantially stable elevated temperature which is slightly below the operating temperature of the device S. The heat pipes can be viewed separately and said to be a means for rapidly heating and cooling the area of greater mass in response to changes in temperature of the heater structure H and to thereby effect operation of the device S and temperature control of the heater construction.

In practice, the heating elements R', heat pipes P and switching devices S and S' are closely related to each other and are arranged within the mass of the body B so that only the temperature of the portion of the body in close proximity about the switching devices need to be changed to any appreciable extent in the normal operation of the construction. The remainder of the mass defining the body B, spaced from the portion thereof about and adjacent to the devices S and S', establishes a heat sink to store that heat which is generated by the elements R' and which is required to maintain the mean temperature of the overall mass of the body at the above noted desired substantially stable temperature.

It will be apparent that to attain the above noted end results with reasonable accuracy, the mass of the body B, the size, extent and heat conducting capacity of the heat pipes P, the watt output of the elements R', the relative positioning of the switching devices in the body and with the elements R' and pipes P, and the thermal mass per unit area and watt density of the heater structure H must be suitably balanced.

In practice, it has been determined that when balancing the means M for and with a heater structure heater H of predetermined mass per unit area and watt output, balancing of the construction for effective operation can be readily calculated and can normally be effected by adjusting the watt density of the elements R' and/or by adjusting the size, extent and resulting heat conductivity of the heat pipes P.

In practice, heater constructions embodying our invention have been employed to heat water beds. In such use of our heater construction, heat demand and heat output is readily established and maintained in substantial equilibrium. As a result of attaining such equilibrium, it has been possible to satisfy heat requirements or demands with heater structures H having far less watt output than is required by any blanket type heater structures provided by the prior art and which are employed to heat waterbeds. The provision and satisfactory use of such a low watt output heater construction, in addition to obvious reduction of power consumed and resulting economy of operation, affords greater safety in operation and materially extends the service of life of both the heater constructions and of the structures heated thereby by reducing heat fatigue and the like which frequently occurs where widely fluctuating temperatures are encountered over protracted periods of time.

The control means M of the heater H here provided performs dual functions under two different conditions. First, it provides an accurate and dependable temperature responsive switching means at the heater which is responsive to the temperature of a mass to be heated and which is in heat conducting contact therewith. To this end, the thermal responsive switching device S is positioned within the body B. The body presents a large service area about the switching device and is in heat conducting contact with the mass to be heated. The mass of the body about the switching device S is heated minimally by the secondary heating element R'. The element R', in essence, prevents heat loss through and from the body about the switching device into structures other than the mass being heated without unduly affecting the device.

In the case of heating a water bed, the water bed mattress, filled with water, is set on a supporting structure on which the heater construction is set and is arranged above and in heat conducting contact with the heater construction and with a portion thereof draped over and in intimate heat conducting contact with the body B in which the switching device S is arranged. In such a case, since those portions of the mass of the body occurring below the switching device and engaging the supporting struxture are heated minimally by the heating elements R', as noted above, the switching device S is only operatively responsive to and in effect senses the temperature of the mattress. This construction and relationship of parts, together with the heat pipes P which are related thereto and which function as previously described, operates so that a substantially absolute predictable temperature differential between ambient temperature at and about the switching device and the temperature of the water bed mattress is attained. In practice, for example, a temperature differential of 20° F. (plus or minus 3° F.) between the ambient temperature at and about the switching device S and the top surface temperature of the water bed mattress is consistently and dependably attainable.

In the example given above, where the water bed mattress is to be heated and maintained at one predetermined temperature, for example, at 85° F., and the temperature differential between the ambient temperature at and about the switching device S is 20° F., the switching device S is constructed or set to open at 115° F. F. and functions to control operation of the heater whereby the temperature of the mattress is maintained at 85° F. (plus or minus 3° F.). In such a case, the switching device S' which is included in our construction can be constructed or set to open at, for example, 125° F. so that if the switching device S fails to operate or open when and as intended and the heater H continues to heat the mattress, the switching device S' will open when the temperature of the mattress reaches 102° F. (plus or minus 3° F.) which temperature is generally recognized in the water bed industry as the maximum safe temperature for water beds.

It is common practice to provide manually adjustable temperature control means for water beds. Such means commonly include manually adjustable switching means engageable in the power supply lines extending to the water bed heaters and temperature sensing probes which are engaged beneath the water bed mattresses and are connected with the said switching means, whereby the switching means open and close when the temperatures of the mattresses, sensed by the probes, rise above and/or drop below selected, set temperatures. Such manually adjustable temperature control means are not wholly dependable and are subject to malfunctioning in such a way that the heaters remain energized and continue to heat their related mattresses after selected or set temperatures have been exceeded.

In practice, when our heater construction is used in combination with a water bed mattress and a related manually adjustable temperature control means such as noted above, the temperature responsive switching devices S and S' can, for example, be manufactured or set to open at 80° F. and are such that both or one or the other of said devices opens when the manually adjustable control means fails to function properly and the temperatures of the mattresses reach 102° F.

The foregoing functions of our heater construction relate to its utility for accurately controlling and/or limiting the temperature of the structures with which the heater is related and is intended to heat.

The second purpose and function of our new heater structure is to provide a control means which quickly operates to de-energize the heater when the heat sink or mass being heated is not in engagement with the heater structure or is rendered ineffective as a heat sink. In such circumstances, or under such conditions, the temperature of the heater structure H of our construction is subject to rapidly rise to destructively high temperatures.

In the case of water beds, the heater structure H that we provide might, for a number of reasons, be moved or the water bed mattress might be moved or shifted in a manner so that proper heat conducting contact between the heater structure H and the mattress is interrupted or broken. Further, the water bed mattress might rupture and spill or it might leak to an extent that sufficient water drains therefrom to render it ineffective as a heat sink for satisfactory and safe operation of the heater. Still further, it is not infrequent that when installing water beds, water bed heaters are placed beneath the mattresses, plugged in and energized before water is introduced into the mattresses. In such cases, the mattresses not only fail to establish suitable heat sinks for the heat generated by the heaters, but act as insulation about and prevent the dissipation of heat that is generated by the heaters.

When any of the above conditions occur and there is no place for generated heat to be disposed of or carried away, the temperature of the heater structure H would, in the absence of the control means that we provide, rapidly rise to extremely dangerous and destructive temperatures.

Some commercially available water bed heaters provided by the prior art have no means to prevent overheating and self-destruction of the heaters when the above noted conditions occur. As a result, such heaters are known to have become heated to destructive temperatures and caused serious bodily injuries and extensive property damage when such conditions have occurred.

In the case of our heater construction, the above noted hazardous conditions are aggravated by the low thermal mass of the thin, flexible heater structure H in relationship to the high thermal mass of the body B related to thermal responsive switching means. The low watt density and the second elements R' and relative high watt density of the primary element R further aggravates the noted hazardous conditions.

In furtherance of our invention and to achieve a quick temperature rise at and within the means M so as to effect the energizing of the heater when the temperature of the heater structure H commences to rise rapidly due to the lack of or insufficiency of a related heat sink structure, the means M includes the aforementioned heat pipes P. Under such conditions, the heat pipes P rapidly conduct heat from the overheated portions of the construction adjacent the element R to the mass of the body B at or adjacent to the switching device to effect operation and opening of those devices, independent of the secondary heating elements R' and/or heat that might be conducted into the body B from some external source, such as from the mass being heated.

It will be apparent that as soon as the above noted dangers and abnormal conditions develop, the temperature of the heater structure H in which the outer ends of the heat pipes P are engaged, increases rapidly and a high differential in temperature is created between the heater structure H and the body B of the means M. The differential of temperatures is such that heat is rapidly and directly conducted through the heat pipes from the structure H to the body B and rapidly elevates the temperature of the body B about the switching devices to an extent or temperature where the switching devices open and de-energize the construction. In practice, the construction is preferably designed and balanced so that if and when the above noted adverse conditions exist, sufficient heat is conducted through the heat pipes P to the body B about the switching devices to effect opening of those devices before the temperature of the heater structure H reaches a potentially destructive temperature, for example, 212° F.

In normal use and operation of the heater that we provide where a related water bed mattress or the like provides an adequate heat sink, heat generated by the element R is rapidly transferred from the heater structure into the mattress and the temperature of the heat pipes P, at or adjacent the element R remains very low. Accordingly, very little or a negligible amount of heat is conducted by the heat pipes P from the heater structure H to the body B of the means M during normal operation of the construction. Further, the heat pipes P extend through the unheated areas of the construction which occur between the elements R and R' whereby the small amount of heat conducted by the heat pipes from the area of the element R toward the body B, during normal operation of construction, is conducted into and dissipated by the unheated portions of the consttuction and before it reaches the body B.

From the foregoing, it will be apparent that our present invention provides a novel blanket-type resistance heater structure having novel temperature control means.

Having described only one typical preferred form and application of our invention, we do not wish to be limited to the specific details herein set forth but wish to reserve to ourselves any modifications and/or variations that may appear to those skilled in the art and which fall within the scope of the following claims:

Having described our invention, we claim:

1. A heater construction having a portion of minor mass in which an elongate electric resistance primary heating element is arranged and a portion of major mass in which a normally open thermo responsive switching device is arranged and set to open when the temperature of the portion of minor mass reaches a predetermined, elevated, control temperature and to close when the temperature of the portion of minor mass is below said control temperature, a secondary elongate electric resistance heater element in the portion of greater mass to normally maintain that mass at a mean elevated temperature which is below said control temperature, a power supply circuit connected with the heating and heater elements and in which the switching device is connected to control the supply of power to said elements and an elongate heat conducting heat pipe in and extending between the portions of minor and major mass and conducting heat therebetween whereby the temperature of the portion of greater mass at the switching device is rapidly changed in response to corresponding changes in temperature of the area of minor mass, the portion of minor mass includes a flat, normally horizontal core of dielectric material, said primary heating element is an elongate metallic conductor on one surface of and carried by the core and an envelope of dielectric material enclosing the core and including top and bottom laminates with central portions overlying the top and bottom surfaces of the core and edge portions about the perimeter of the core and integrally joined.

2. The heater construction set forth in claim 1 wherein the primary heating element and switching device are series connected.

3. The heater construction set forth in claim 1 wherein the primary heating elements, switching device and secondary heater elements are series connected.

4. The heater construction set forth in claim 1 wherein the core is established of a thin, flexible film of plastic material which is dimensionally and thermally stable under the mechanical and thermal stresses to which the heater construction is to be subjected, the primary heating element is an elongate flexible ribbon of metal foil arranged about and bonded to a surface of the core; and said envelope is established of a thin, flexible film of plastic material which is thermally stable under the thermal stresses to which the heater construction is to be subjected and wherein the film plastic material of the envelope is bonded to adjacent surfaces of the core.

5. The heater construction set forth in claim 4 wherein the primary heating elements, switching device and secondary heating elements are series connected.

6. The heater construction set forth in claim 5 wherein the secondary heater element is a metal foil element bonded on a portion of the core remote from the primary heating elements; said heat pipe is an elongate metal ribbon on the surface of the core opposite the surface of the core on which the elements are arranged; said portion of greater mass is defined by the portion of the core on which the secondary heating element is bonded; the portion of the heat pipe related to that portion of the core, the portion of the envelope at that portion of the core, and by a body of dielectric material on and projecting from the envelope adjacent that portion of the core and in which the switching device is arranged.

7. The structure set forth in claim 6 wherein said body encapsulates power terminals for the heater and heating elements, an end portion of an elongate power supply cord, power lines extending from the cord therefrom to said terminals, coupling means securing the lines and terminals together, and said switching device.

8. A heater construction having a portion of minor mass in which an elongate electric resistance primary heating element is arranged and a portion of major mass in which a normally open thermo responsive switching device is arranged and set to open when the temperature of the portion of minor mass reaches a predetermined, elevated, control temperature and to close when the temperature of the portion of minor mass is below said control temperature, a secondary elongate electric resistance heater element in the portion of greater mass to normally maintain that mass at a mean elevated temperature which is below said control temperature, a power supply circuit connected with the heating and heater elements and in which the switching device is connected to control the supply of power to said elements and an elongate heat conducting heat pipe in and extending between the portions of minor and major mass and conducting heat therebetween whereby the temperature of the portion of greater mass at the switching device is rapidly changed in response to corresponding changes in temperature of the area of minor mass, the portion of minor mass includes a flat, normally horizontal envelope including top and bottom laminates between which the primary heating element is arranged and wherein said portion of greater mass is defined by a portion of the envelope remote from said primary heating element and a body of dielectric heat absorbing material carried thereby.

9. The heater construction set forth in claim 8 wherein the primary heating elements, switching device and secondary heater elements are series connected.

* * * * *